US006889711B2

(12) United States Patent
Vetoretti et al.

(10) Patent No.: US 6,889,711 B2
(45) Date of Patent: May 10, 2005

(54) TUBE FOR FEEDING FASTENING ELEMENTS FOR A FASTENING APPARATUS

(75) Inventors: Alain Vetoretti, Bourge les Valence (FR); Patrick Herelier, Saint Jean de Muzols (FR)

(73) Assignee: Societe de Prospection et d'Inventions Techniques Spit, Bourg-les-Valence (FR)

( * ) Notice: Subject to any disclaimer, the term of this patent is extended or adjusted under 35 U.S.C. 154(b) by 0 days.

(21) Appl. No.: 10/694,386

(22) Filed: Oct. 28, 2003

(65) Prior Publication Data

US 2004/0144442 A1 Jul. 29, 2004

(30) Foreign Application Priority Data

Oct. 30, 2002 (FR) ..... 02 13597

(51) Int. Cl.[7] ..... B21J 15/32; F15D 1/00

(52) U.S. Cl. ..... 138/38; 138/37; 138/177; 193/2 R; 227/149

(58) Field of Search ..... 138/38, 177, 178, 138/DIG. 11, 104, 103, 37; 193/2 R; 221/307; 222/213, 214; 227/149, 119

(56) References Cited

U.S. PATENT DOCUMENTS

| | | | | | |
|---|---|---|---|---|---|
| 2,995,151 | A | * | 8/1961 | Lockwood | 138/121 |
| 3,748,215 | A | * | 7/1973 | Lenzi | 428/36.9 |
| 4,020,974 | A | * | 5/1977 | Bauer et al. | 221/307 |
| 4,244,134 | A | * | 1/1981 | Otterson | 43/58 |
| 4,336,872 | A | | 6/1982 | Noda et al. | 193/2 R |
| 4,340,035 | A | * | 7/1982 | Begun | 126/676 |
| 4,515,149 | A | * | 5/1985 | Sgroi et al. | 126/651 |
| 4,982,653 | A | * | 1/1991 | Gordon et al. | 454/335 |
| 5,383,100 | A | * | 1/1995 | Kikos | 362/34 |
| 5,398,860 | A | * | 3/1995 | Edwards | 227/149 |
| 5,480,087 | A | * | 1/1996 | Young et al. | 227/112 |
| D375,159 | S | * | 10/1996 | Johansson | D24/112 |
| 5,692,664 | A | | 12/1997 | Vettoretti et al. | 227/10 |
| 6,185,859 | B1 | * | 2/2001 | Pirkle | 43/54.1 |
| 6,354,331 | B1 | * | 3/2002 | Fisher et al. | 138/104 |
| 6,583,535 | B1 | * | 6/2003 | Lumpp | 313/110 |
| 6,796,454 | B1 | * | 9/2004 | Matthews et al. | 221/197 |

FOREIGN PATENT DOCUMENTS

| | | | | |
|---|---|---|---|---|
| DE | 195 41 674 A1 | | 5/1996 | |
| EP | 0 567 240 A1 | | 3/1993 | |
| GB | 2182430 A | * | 5/1987 | F24J/2/50 |

* cited by examiner

*Primary Examiner*—Patrick Brinson
(74) *Attorney, Agent, or Firm*—Lowe Hauptman & Berner, LLP

(57) ABSTRACT

The sealing apparatus (100) is used in a substantially vertical position by the user, who inserts a magazine pack containing nails into the hopper (101). After unlocking of the hopper (101), the nails slide in the flexible feed tube (10) as far as the front of a feeder for indirect firing, in a buffer guide (102). The user then merely has to actuate a trigger (103) in order to entrain the nails into the support via the feeder. In order to preserve the transparent quality of the tube (10), its effective inner cross section (21) is not circular, but is arranged (23) such that the contact between the lateral wall of the circular head of the nail (1) and the effective inner wall (21) of the tube (10) is not possible on certain portions (22) of the effective inner wall (21).

21 Claims, 3 Drawing Sheets

TUBE FOR FEEDING FASTENING ELEMENTS FOR A FASTENING APPARATUS

FIELD OF THE INVENTION

The invention relates to a fastening apparatus for inserting fastening elements in a support material such as an indirect-firing sealing apparatus that an operator is able to use while standing, for example for fastening a roofing panel to a roof.

The application applies to all types of fastening apparatus that use fastening elements that have a head and a stem. It therefore applies particularly to sealing apparatuses for embedding nails or, alternatively, to automatic screwdrivers for screwing in screws. The remainder of the description will often make reference to sealing apparatuses, but the applicant intends no limitation to this type of apparatus.

BACKGROUND OF THE INVENTION

Thus, in an indirect-firing sealing apparatus, the nails are inserted into the gun of the apparatus, forward of the feeder, via a flexible feed tube extending between the downstream gun and an upstream hopper, which hopper is intended for receiving a magazine pack of nails that is dropped into and slid along the tube after the bottom of the hopper has been unlocked.

The flexible feed tubes are made from a transparent material so that the filling status of the feed tube can be ascertained. In point of fact, after a certain period of use and therefore of friction from the nails, essentially via their circular head, against the inner wall of the tube, this wall becomes opaque.

SUMMARY OF THE INVENTION

The present invention aims to preserve the transparent quality of the feed tube.

To this end, the invention relates to a tube, for feeding fastening elements with a circular head, for a fastening apparatus, made from transparent material, characterized in that its effective inner cross section is not circular.

Owing to the non-circular nature of the cross section of the tube, part of its inner wall escapes contact with the heads of the fastening elements when they slide in the tube, and it thus remains transparent.

In an advantageous embodiment, the inner wall of the tube is ribbed longitudinally, it being possible for the ribs to be attached to an original inner wall of circular cross section in the form of beading made from a material other than that of the tube.

In another embodiment, the inner cross section of the tube is substantially polygonal, for example triangular.

In yet another embodiment, the inner cross section of the tube has a substantially rounded-star shape.

BRIEF DESCRIPTION OF THE DRAWINGS

The invention will be better understood with the aid of the following description of the preferred embodiments of the tube of the invention, with reference to the appended drawing, in which.

DETAILED DESCRIPTION OF THE PREFERRED EMBODIMENTS

Figure 1:
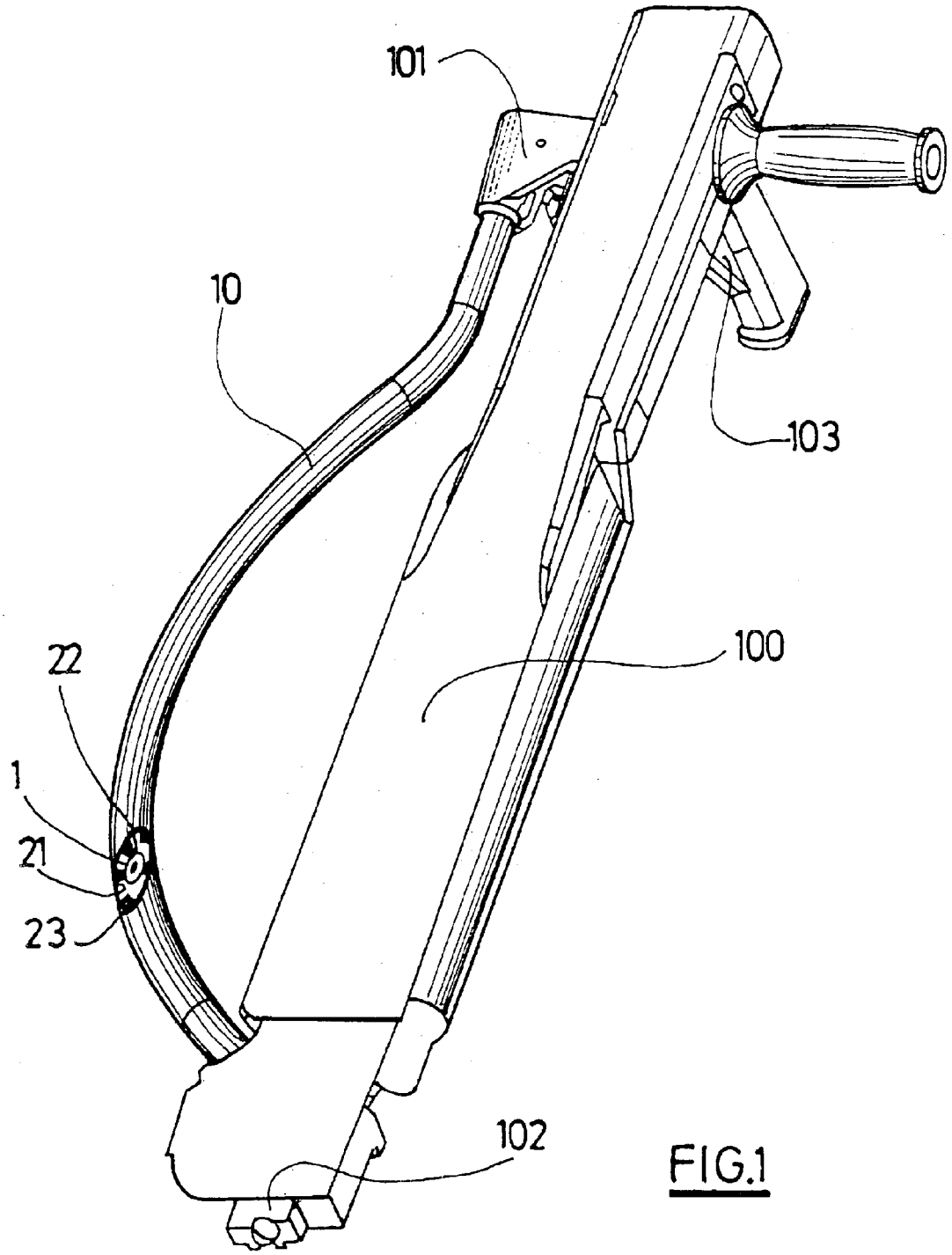
FIG. 1 shows a sealing apparatus with a tube of the present invention.
Figure 2:
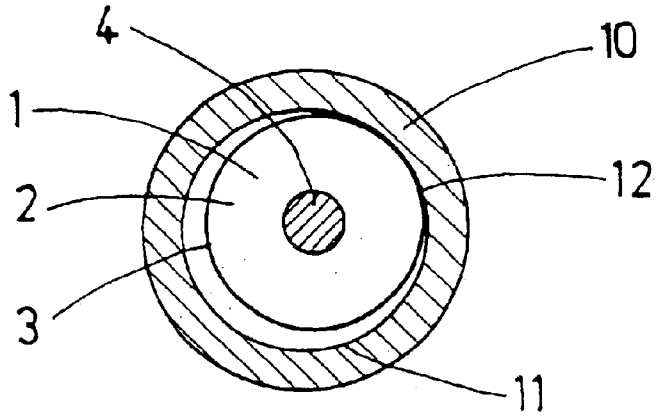
FIG. 2 shows a sectional view of a tube of the prior art, with a nail.

With reference to FIGS. 1 and 2, the sealing apparatus 100, which is the example of a fastening apparatus considered in this case, is used in a substantially vertical position by the user who is able to place a magazine pack containing nails 1 in a hopper 101 provided for this purpose. After unlocking of the hopper 101, the nails 1 slide in a flexible tube 10 as far as the front of a feeder, for indirect firing, in a buffer guide 102. The user then simply has to actuate a trigger 103 in order to entrain the nails into the support via the feeder.

With reference to FIG. 2, when a nail 1 with a circular head 2 and a stem 4 slides in the tube 10, namely, in this case, a tube 10 with a circular effective inner cross section 11, the entire inner surface 11 of the tube 10 is likely to be in contact (12) with the lateral surface 3 of the circular head 2 of the nail 1. Therefore, even if the diameter of the circular head 2 of the nail 1 is smaller than that of the circular inner cross section of the tube 10, there may be surface contact 12 between the lateral surface 3 of the circular head 2 of the nail 1 and the inner surface 11 of the tube 10, it being possible for this contact surface 12 statistically to occupy any portion of the inner surface 11 when the nail 1 slides. Thus, the entire inner surface 11 of the tube 10 is likely, as nails 1 pass through, to enter into contact with the circular head 2 of a nail 1. The entire inner wall 11 of the tube 10 will thus be damaged by this passing-through and become opaque.

The present invention aims to require the nail 1 to make contact with certain inner portions of the tube, enabling the rest of the inner surface to remain transparent.

Figure 3:
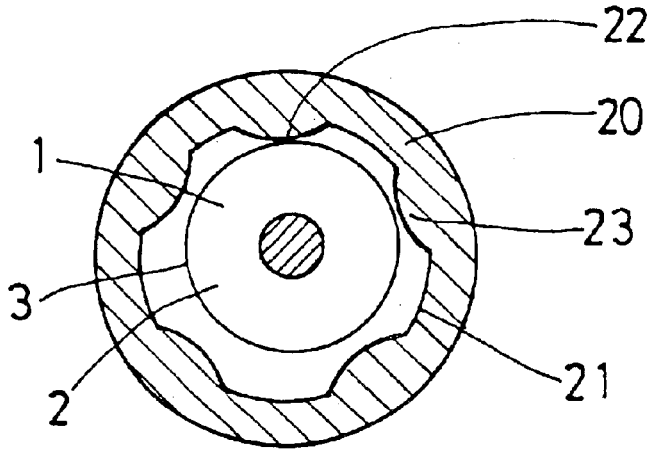
FIG. 3 shows a sectional view of a first embodiment of the tube of the present invention.

Thus, with reference to FIG. 3, the effective inner wall 21 of a tube 20 is ribbed longitudinally, the ribs 23 being shaped so that the contact 22 between the lateral wall 3 of the circular head 2 of the nail 1 and the effective inner wall 21 of the tube 20 occurs only at the longitudinal ribs 23. The inner surface 21 will therefore become opaque only at the ribs 23. The ribs 23 are in this case directly injection-moulded together with the rest of the inner wall 21 of the tube 20 and are made from the same material as that of the tube 20.

Reference has been made to the component elements of FIG. 3 in section in FIG. 1 in order to facilitate understanding of the invention.

Figure 4:
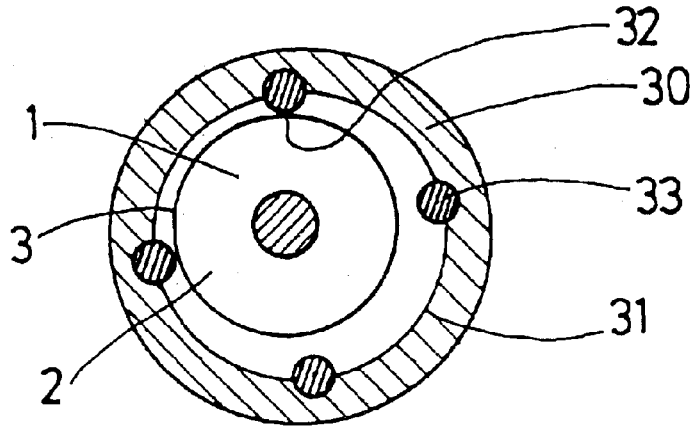
FIG. 4 shows a sectional view of a second embodiment of the tube of the present invention.

With reference to FIG. 4, provision may be made for an original tube 30 with a circular inner cross section to which beadings 33, made from a material other than that of the tube 30, are attached, forming longitudinal ribs 33. Thus, the effective inner surface 31 of the tube 30 is the result of the combination of the initial circular inner surface and of the inner surface of the beadings. It is in fact the initial inner surface, except at the locations of the beadings 33, where the inner surface taken into account is that of the beadings 33, until said surface is further away from the centre of the tube than the initial inner surface. This results in the lateral wall 3 of the circular head 2 of the nail 1 being able to enter into contact (32) with the effective inner surface 31 of the tube 30 only at the beadings 33. The inner surface 31 will therefore become opaque only at the beadings 33.

Figure 5:
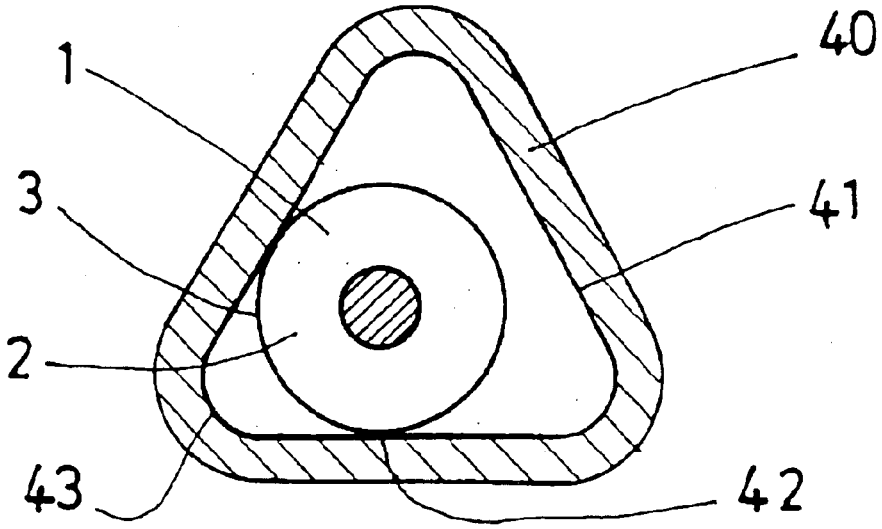
FIG. 5 shows a sectional view of a third embodiment of the tube of the present invention.

With reference to FIG. 5, it is possible to use a tube 40 with an effective inner cross section 41 of substantially polygonal shape, in this case a substantially triangular shape. The dimensions of the tube 40 are configured so that the lateral wall 3 of the circular head 2 of the nail 1 can never enter into contact (42) with the dihedra 43 of the inner surface 41 of the tube 40. The inner surface 41 will therefore not become opaque at the dihedra 43. The choice of dimensions of the tube 40 obviously affects the proportion of inner surface 41 that never enters into contact with the nails 1.

Figure 6:
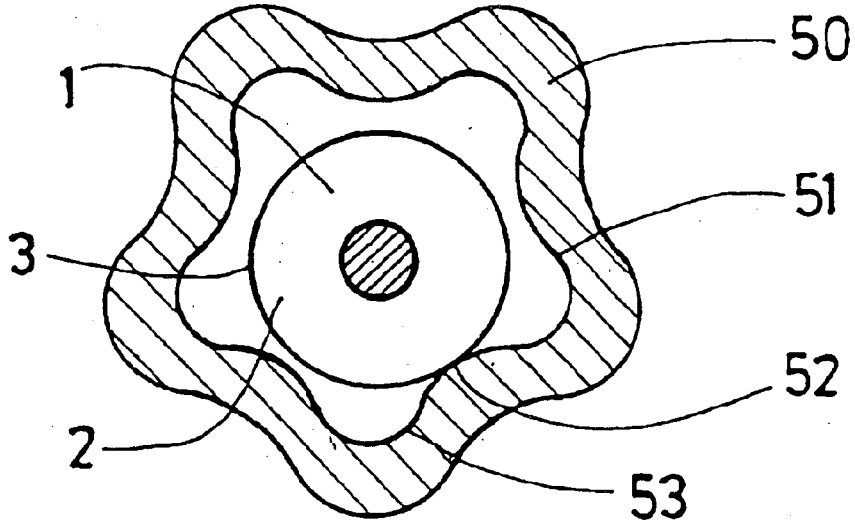
FIG. 6 shows a sectional view of a fourth embodiment of the tube of the present invention.

With reference to FIG. 6, it is also advantageous to use a tube 50 with an effective inner cross section 51 of substantially rounded-star shape. The tube 50 is in this case configured so that the lateral wall 3 of the circular head 2 of the nail 1 can never enter into contact (52) with the rounded dihedra 53 of the star shape. The inner surface 51 will therefore not become opaque at the dihedra 53.

By virtue of the various embodiments of the invention described above, it is always possible to preserve, on the wall of the tube, transparent portions right along the tube. It goes without saying that any other shape of effective inner cross section can be envisaged for the tube, as long as it allows certain portions to escape any contact with the lateral wall 3 of the head 2 of the nails 1.

It will be noted that the inner cross section of the tube of the invention may be effective either for the nails or for the operator. In fact, both notions have been taken into account in order, by "effective", to imply "actual".

What is claimed is:

1. A tube for feeding fastening elements for a fastening apparatus, said tube being flexible and made from transparent material, and having an inner cross section which is not circular;

wherein said non-circular inner cross section includes a first section and a second section being contiguous to the first section and extending radially inwardly from the first section for a length sufficient to prevent physical contact between the first section and heads of the fastening elements being fed alone the tube; and wherein said tube is transparent in said first section.

2. The tube according to claim 1, wherein the second section includes at least one rib extending longitudinally of said tube.

3. The tube according to claim 2, wherein said tube, including said at least one rib, is entirely, integrally made from said transparent material.

4. The tube according to claim 2, wherein said tube, except said at least one rib, is entirely made from said transparent material.

5. The tube according to claim 1, wherein the inner cross section is of a substantially polygonal shape.

6. The tube according to claim 5, wherein the inner cross section is of a substantially triangular shape.

7. The tube according to claim 1, wherein the inner cross section has a substantially rounded star shape.

8. The tube according to claim 1, consisting of said transparent material.

9. The tube according to claim 1, being transparent in an entirety thereof.

10. The tube according to claim 2, wherein a thickness of said tube in the first section is less than in the second section including said at least one rib.

11. The tube according to claim 2, wherein said at least one rib is an elongated element made of a material different from said transparent material, said elongated element being partially embedded in said transparent material.

12. In combination, at least one fastening element having a head and a stem; and a tube for feeding said at least one fastening element to a fastening apparatus, said tube having an inner surface which is sized and shaped relative to the head of said at least one fastening element to physically contact the head of said fastening element being fed along said tube only at predetermined locations, leaving a remaining area of said inner surface free of physical contact with the head of said at least one fastening element at all times wherein said tube is transparent in at least said remaining area, whereby said at least one fastening element can be seen through said tube in said remaining area.

13. The combination of claim 12, wherein the head of said at least one fastening element is circular and a cross section of the inner surface of said tube is non-circular.

14. The combination according to claim 1, including at least one inner rib extending longitudinally of said tube, wherein said at least one rib defines the predetermined locations where the tube physically contacts the head of said at least one fastening element, and wherein regions of the inner surface adjacent to and located on opposite sides of said at least one rib define the remaining area.

15. The combination according to claim 14, wherein said tube, including said at least one rib, is entirely, integrally made from said transparent material.

16. The combination according to claim 15, wherein a thickness of said tube in the remaining area is less than in a region of said at least one rib.

17. The combination according to claim 14, wherein said tube, except said at least one rib, is entirely made from said transparent material.

18. The combination according to claim 17, wherein said at least one rib is an elongated element made of a material different from said transparent material, said elongated element being partially embedded in said transparent material.

19. The combination according to claim 12, wherein a cross section of the inner surface has a substantially polygonal shape.

20. The combination according to claim 12, wherein a cross section of the inner surface has a substantially rounded star shape.

21. The combination according to claim 12, wherein said at least one fastening element is one of a nail and a screw.

* * * * *